US008256474B2

(12) United States Patent
Stienen

(10) Patent No.: US 8,256,474 B2
(45) Date of Patent: Sep. 4, 2012

(54) BEVERAGE BOTTLING PLANT FOR FILLING BOTTLES WITH A LIQUID BEVERAGE, HAVING A FLOW METER INTEGRATED INTO THE FILLING ELEMENT AND LOCATED IN THE FLOW PATH FOR FILLING BOTTLES WITH A LIQUID BEVERAGE AND A FILLING MACHINE HAVING SUCH A FILLING ELEMENT

(75) Inventor: Thomas Stienen, Dortmund (DE)

(73) Assignee: KHS GmbH, Dortmund (DE)

( * ) Notice: Subject to any disclaimer, the term of this patent is extended or adjusted under 35 U.S.C. 154(b) by 1017 days.

(21) Appl. No.: 12/235,133

(22) Filed: Sep. 22, 2008

(65) Prior Publication Data

US 2009/0071569 A1 Mar. 19, 2009

Related U.S. Application Data

(63) Continuation-in-part of application No. PCT/EP2007/002574, filed on Mar. 23, 2007.

(30) Foreign Application Priority Data

Mar. 24, 2006 (DE) ..... 10 2006 014 103

(51) Int. Cl.
*B65B 3/04* (2006.01)

(52) U.S. Cl. ..... 141/144; 141/96; 141/392; 53/281; 53/503

(58) Field of Classification Search ..... 141/96, 141/144–146, 301, 392; 53/281, 503
See application file for complete search history.

(56) References Cited

U.S. PATENT DOCUMENTS 4,077,182 A * 3/1978 Papaluca ..... 53/109
(Continued)

FOREIGN PATENT DOCUMENTS

DE 3 842 578 6/1990
(Continued)

OTHER PUBLICATIONS

International Search Report PCT/EP2007/002574 and English translation thereof.

*Primary Examiner* — Gregory Huson
*Assistant Examiner* — Nicolas A Arnett
(74) *Attorney, Agent, or Firm* — Nils H. Ljungman & Associates

(57) ABSTRACT

A beverage bottling plant for filling bottles with a liquid beverage, having a flow meter integrated into the filling element and located in the flow path for filling bottles with a liquid beverage and a filling machine having such a filling element. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

18 Claims, 7 Drawing Sheets

U.S. PATENT DOCUMENTS

| | | | | |
|---|---|---|---|---|
| 4,283,901 | A * | 8/1981 | Schieser et al. | 53/75 |
| 4,519,184 | A * | 5/1985 | Brunswick | 53/503 |
| 5,713,403 | A * | 2/1998 | Clusserath et al. | 141/101 |
| 6,378,575 | B1 * | 4/2002 | Marchau | 141/234 |
| 6,463,964 | B2 * | 10/2002 | Clusserath | 141/40 |
| 6,474,368 | B2 * | 11/2002 | Clusserath et al. | 141/6 |
| 6,892,771 | B2 * | 5/2005 | Stocchi | 141/129 |
| 7,104,033 | B2 * | 9/2006 | Krulitsch | 53/467 |
| 7,243,483 | B2 * | 7/2007 | Clusserath et al. | 53/473 |
| 7,299,607 | B2 * | 11/2007 | Clusserath et al. | 53/503 |
| 7,299,832 | B2 * | 11/2007 | Hartness et al. | 141/144 |
| 7,650,916 | B2 * | 1/2010 | Clusserath | 141/95 |
| 7,819,020 | B2 * | 10/2010 | Jacobi et al. | 73/861.12 |
| 2005/0262804 | A1 * | 12/2005 | Clusserath et al. | 53/281 |

FOREIGN PATENT DOCUMENTS

| | | |
|---|---|---|
| DE | 10 2004 013 211 | 9/2005 |
| EP | 0 274 338 | 7/1988 |
| EP | 1 586 533 | 10/2005 |
| GB | 2 288 168 | 10/1995 |

* cited by examiner

BEVERAGE BOTTLING PLANT FOR FILLING BOTTLES WITH A LIQUID BEVERAGE, HAVING A FLOW METER INTEGRATED INTO THE FILLING ELEMENT AND LOCATED IN THE FLOW PATH FOR FILLING BOTTLES WITH A LIQUID BEVERAGE AND A FILLING MACHINE HAVING SUCH A FILLING ELEMENT

CONTINUING APPLICATION DATA

This application is a Continuation-In-Part application of International Patent Application No. PCT/EP2007/002574, filed on Mar. 23, 2007, which claims priority from Federal Republic of Germany Patent Application No. 10 2006 014 103.2, filed on Mar. 24, 2006. International Patent Application No. PCT/EP2007/002574 was pending as of the filing date of this application. The United States was an elected state in International Patent Application No. PCT/EP2007/002574.

BACKGROUND

1. Technical Field

The present application relates to a beverage bottling plant for filling bottles with a liquid beverage, having a filling element for filling bottles with a liquid beverage and a filling machine having such a filling element.

2. Background Information

Background information is for informational purposes only and does not necessarily admit that subsequently mentioned information and publications are prior art.

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Filling elements for the filling of bottles or similar containers with a liquid product, in particular for the filling bottles with beverages, are known in a variety of designs, including filling elements for volume-controlled filling (volumetric filling). With these filling elements, a flow meter is provided in the liquid line between a source of the liquid product (e.g. reservoir or bowl) and the respective filling element. The flow meter ends the filling process by sending a measurement or control signal that closes the liquid valve to a central control unit (computer) in the filling machine.

OBJECT OR OBJECTS

The object is to indicate a filling element that makes possible a volumetric or volume-controlled filling of bottles or similar containers with a filling machine that features a particularly compact and simplified design. The present application teaches that this object can be accomplished by a rotary-type filling machine construction as claimed below, and a filling element of the type described and claimed hereinafter.

SUMMARY

A filling element taught by the present application has a flow meter which is not necessarily external, but rather in at least one embodiment integral to said filling element. The flow meter is located downstream of the liquid flow valve in the direction of product flow. With an actuator rod for the liquid flow valve, the need for that actuator rod to penetrate the flow meter is obviated. An advantage of such filling elements includes the fact that, even with volume-controlled filling, a particularly compact, overall construction can be achieved. In addition, a filling element configuration like this may enable a reduced number of transition points between the reservoir and the dispenser opening that need gaskets or other seals. The embodiments of the present invention will be described in more detail herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the embodiments are disclosed herein. The embodiments are explained below with reference to the exemplary embodiments that are illustrated in the accompanying figures, in which.

DESCRIPTION OF EMBODIMENT OR EMBODIMENTS

Figure 1:
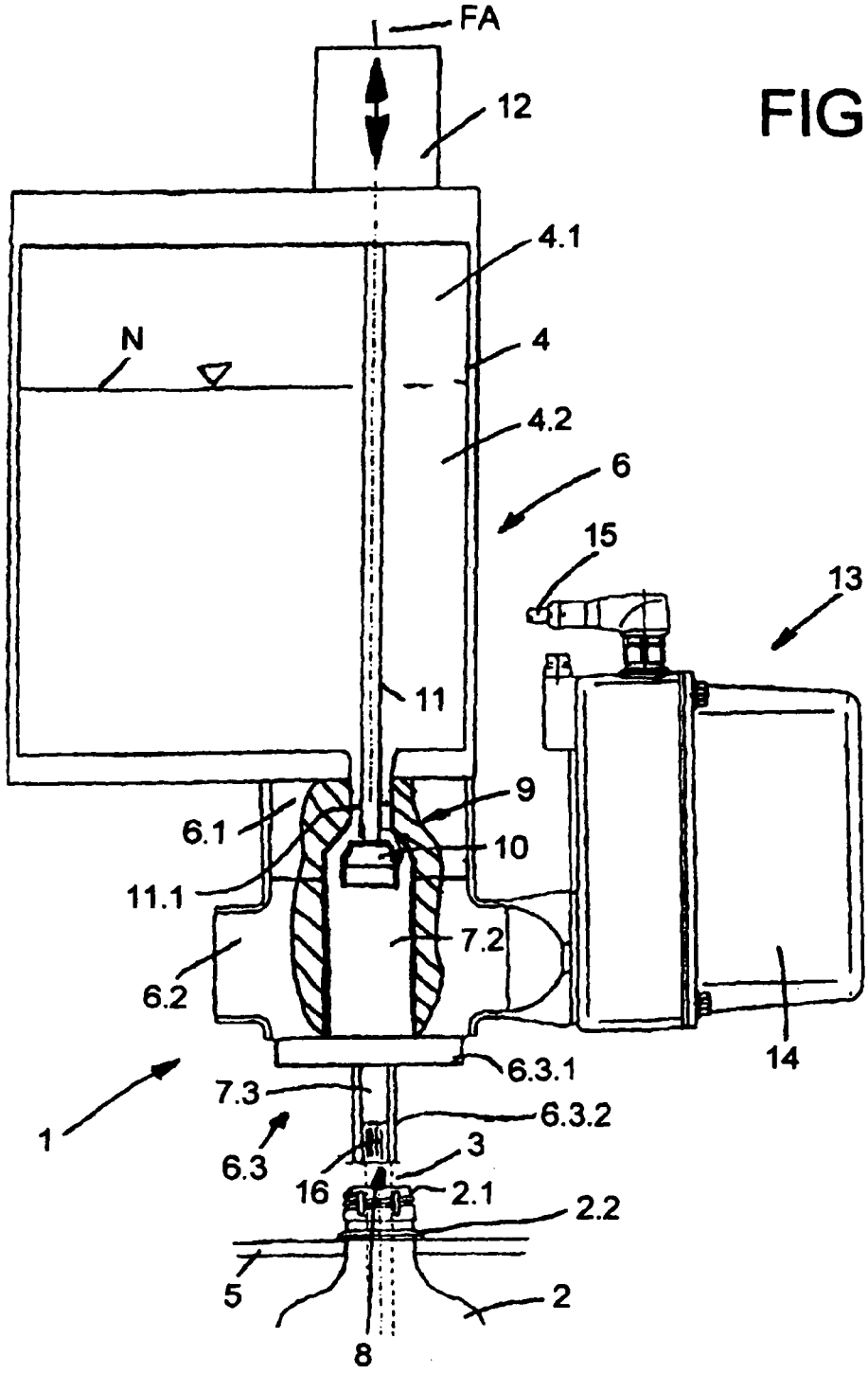
FIG. 1 is a simplified sectional drawing of a filling element of a filling machine with a rotary construction for a pressureless open-jet filling of bottles with a liquid, with the liquid valve open.
Figure 1A:
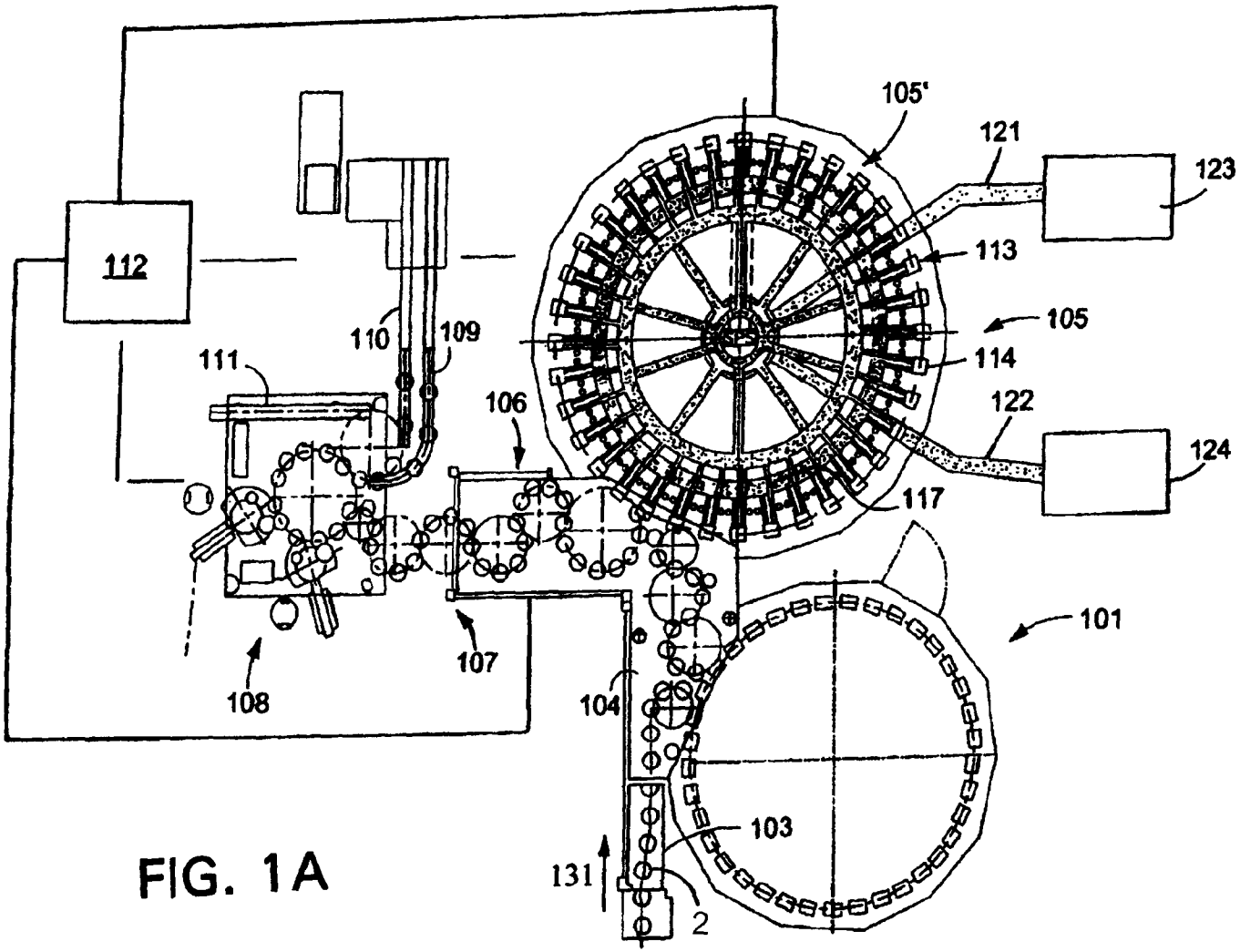
FIG. 1A is a schematic illustration of a container filling plant in accordance with one possible embodiment.

FIG. 1A shows schematically the main components of one possible embodiment example of a system for filling containers, specifically, a beverage bottling plant for filling bottles 2 with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles 2, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 2 are transported to a beverage filling machine 105 by a second conveyer arrangement 104 that is formed, for example, by one or more starwheels that introduce bottles 2 into the beverage filling machine 105.

The beverage filling machine 105 shown is of a revolving or rotary design, with a rotor 105', which revolves around a central, vertical machine axis. The rotor 105' is designed to receive and hold the bottles 2 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 2 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 2, the first product or the second product can be filled by means of an appropriate control of the filling product or fluid valves.

Downstream of the beverage filling machine 105, in the direction of travel of the bottles 2, there can be a beverage bottle closing arrangement or closing station 106 which closes or caps the bottles 2. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 2. In the embodiment shown, the labeling arrangement 108 has three output conveyer arrangements: a first output conveyer arrangement 109, a second output conveyer arrangement 110, and a third output conveyer arrangement 111, all of which convey filled, closed, and labeled bottles 2 to different locations. In the event pre-labeled bottles are used, a beverage labeling station 108 would not necessarily be needed and could be omitted from the process of the beverage bottling plant.

The first output conveyer arrangement 109, in the embodiment shown, is designed to convey bottles 2 that are filled with a first type of liquid beverage supplied by, for example, the supply reservoir 123. The second output conveyer arrangement 110, in the embodiment shown, is designed to convey bottles 2 that are filled with a second type of liquid beverage supplied by, for example, the supply reservoir 124. The third output conveyer arrangement 111, in the embodiment shown, is designed to convey incorrectly labeled bottles 2. To further explain, the labeling arrangement 108 can comprise at least one beverage bottle inspection or monitoring device that inspects or monitors the location of labels on the bottles 2 to determine if the labels have been correctly placed or aligned on the bottles 2. The third output conveyer arrangement 111 removes any bottles 2 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 2:
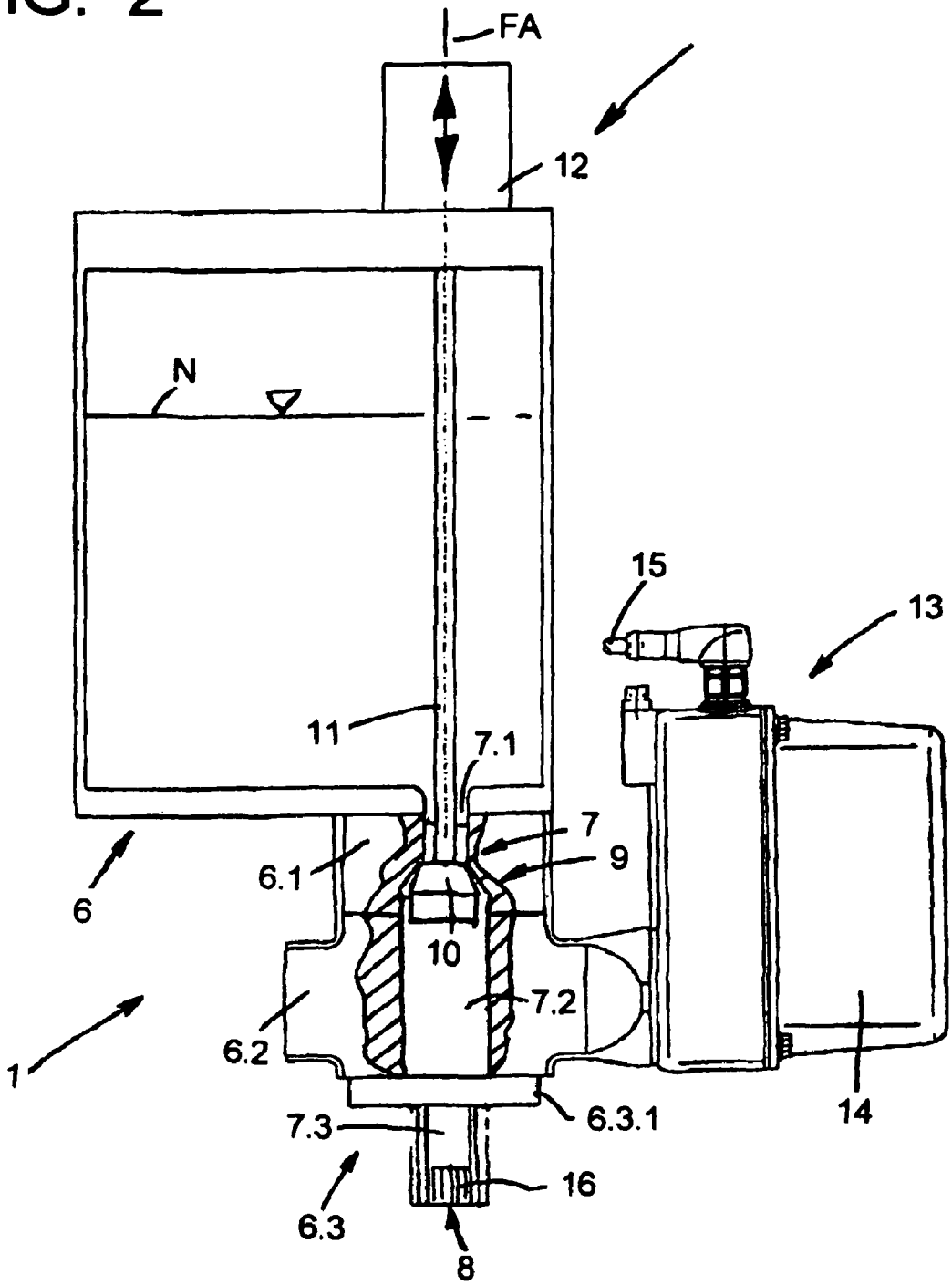
FIG. 2 is an illustration similar to FIG. 1, but with the liquid valve closed.

In FIGS. 1 and 2, item 1 is a filling element for the pressureless bottling of a liquid in containers, i.e. in bottles 2, and in particular for open-jet filling, in which the bottle 2 to be filled is located with its bottle mouth 2.1 at some distance from, but still centered below filling element 1. The liquid being bottled is fed into the bottle 2 in the form of an open jet 3. The filling element 1 is provided together with a plurality of identical filling elements on the periphery of a rotor that can be driven so that it rotates around a vertical machine axis. FIGS. 1 and 2 show only a vessel or bowl 4 for the liquid being bottled and a container carrier or bottle carrier 5 on which individual bottles 2, illustrated in the form of PET bottles, are vertically suspended during the filling process by means of a projecting flange 2.2.

The interior of said bowl 4 is partly filled to a controlled level with the liquid to be bottled, so that above the level N of the surface of the liquid, a gas headspace 4.1 is formed which is occupied by air and/or an inert gas at atmospheric pressure, and below the level N, a liquid space 4.2 is formed which is occupied by the liquid being bottled.

The filling element 1 comprises a filling element housing 6 which, in the illustrated exemplary embodiment, is realized in three parts in the manner described below and in which the conventional liquid duct 7 is realized. That liquid duct empties with its upper end in FIGS. 1 and 2, or with a connection 7.1 on its upper end, directly into liquid space 4.2. And it also forms a dispensing opening 8 on its lower end as shown in the figures. Within liquid duct 7, there is shown, partially in cross-section in FIGS. 1 and 2, a liquid valve 9 which comprises essentially a valve body 10 that interacts with a valve seat in the liquid duct 7, and is provided on the lower end in FIGS. 1 and 2 with a tappet, or actuator rod 11. That rod can be moved by an actuator device 12 provided above bowl 4 in the illustrated embodiment. One such device 12 is a pneumatic piston-cylinder system with an axial stroke necessary for the opening and closing of liquid valve 9. In the illustrated embodiment, actuator rod 11 may have a circular outer section and be oriented in the vertical direction with its axis defining the vertical filling element axis FA.

In the embodiment shown, an individual filling element 1 is provided directly on the underside of the bowl 4 with an actuator rod 11 extending through an interior of that bowl 4. The axis of liquid channel 7 is oriented equi-axially or coaxially with the axis FA. Despite its relatively short length, a centering element 11.1 is provided in the vicinity of the lower end of actuator rod 11 for centering both rod 11 and valve body 10. It goes without saying that the diameter of the liquid duct 7 is greater than the outside diameter of the actuator rod 11, so that in said duct a ring-shaped flow path for liquid forms around actuator rod 11. And centering element 11.1 does not unduly interfere with the flow of liquid being bottled.

As noted above, the filling element housing 6 on the illustrated exemplary embodiment comprises three parts connected to one another in the vertical direction of liquid flow from the bowl 4 to dispensing opening 8. These are, namely: (i) the housing part 6.1 with its connection 7.1; (ii) the housing part 6.2 which is a component of flow meter 13 and has a segment 7.2 that forms the measurement duct to said flow meter 13; and (iii) the housing part 6.3 which is connected with its flange-like section 6.3.1 to the underside of housing part 6.2, and transitions at its other end into tubular section 6.3.2. From the lower end of that latter section, oriented equi-axially or coaxially with axis FA, there is formed a dispensing opening 8. Also formed in housing part 6.3 is the valve seat for the valve body 10 of liquid valve 9. It goes without saying that the transitions between bowl 4 and housing part 6.1, as well as between adjoining housing parts 6.1-6.3, are all sealed with corresponding gaskets. They are especially critical in the vicinity of the liquid duct that runs through all housing subparts.

As noted above, housing part 6.2 is an integral component of the flow meter 13, for example, a magnetic inductive flow meter (MIF). On the measurement duct section 7.2 of same, the components that measure the flow of liquid being bottled are provided with at least one magnet coil to generate a magnetic field, e.g. a magnetic alternating field in the flow of liquid, as well as at least one electrode for the measurement of the electrical voltage generated by the flow of liquid in the magnetic field and quantity of liquid flowing.

As can be seen in FIG. 1, the measurement section 7.2 is located a distance from the dispensing opening 8. This distance, according to at least one possible embodiment, is approximately two, three, four, five, or six times the diameter of the dispensing opening 8. Consequently, the measurement section 7.2 of the flow meter 13 is located relatively close to the dispensing opening 8.

Figure 1B:
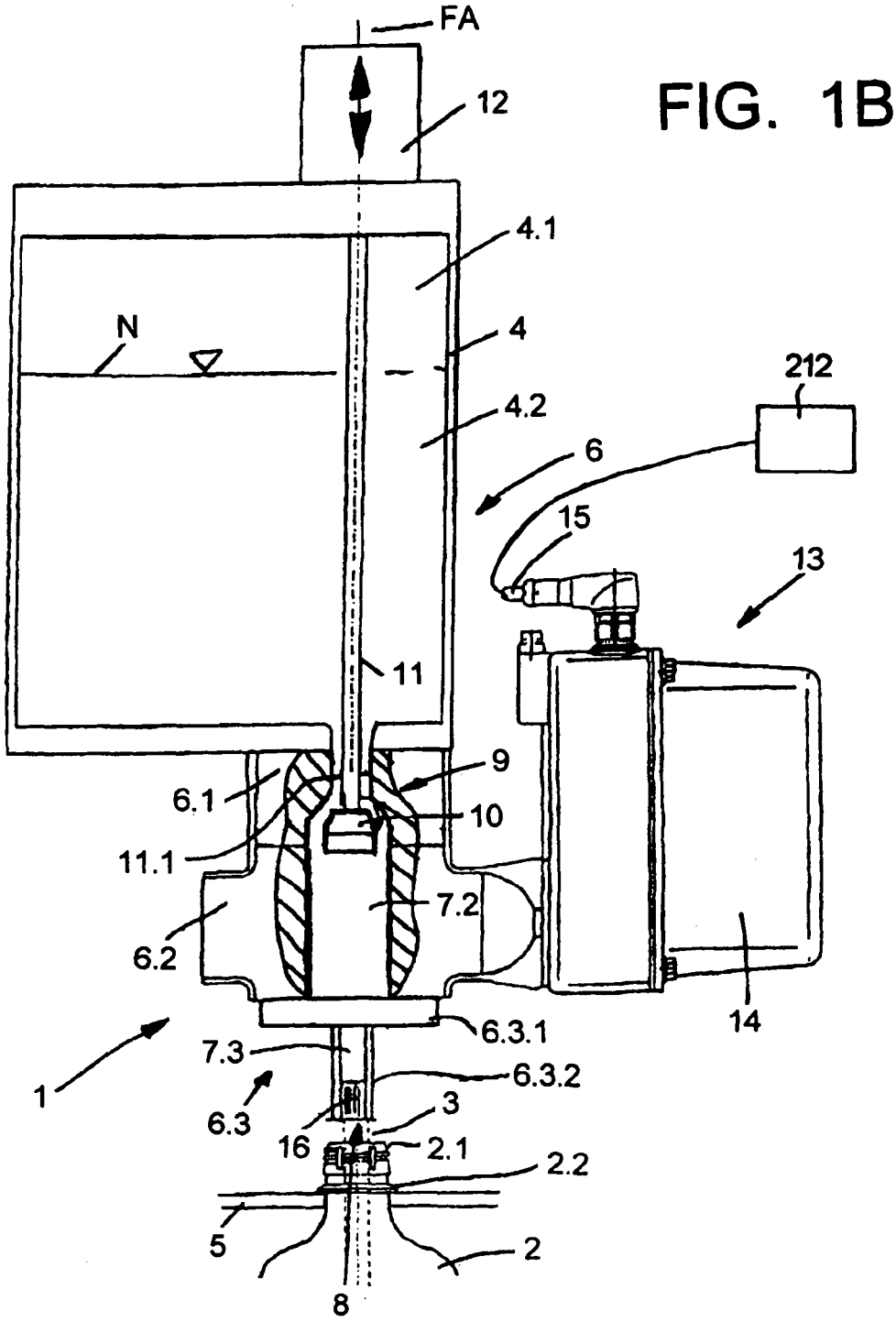
FIG. 1B shows an embodiment similar to FIG. 1 including a control unit.
Figure 1C:
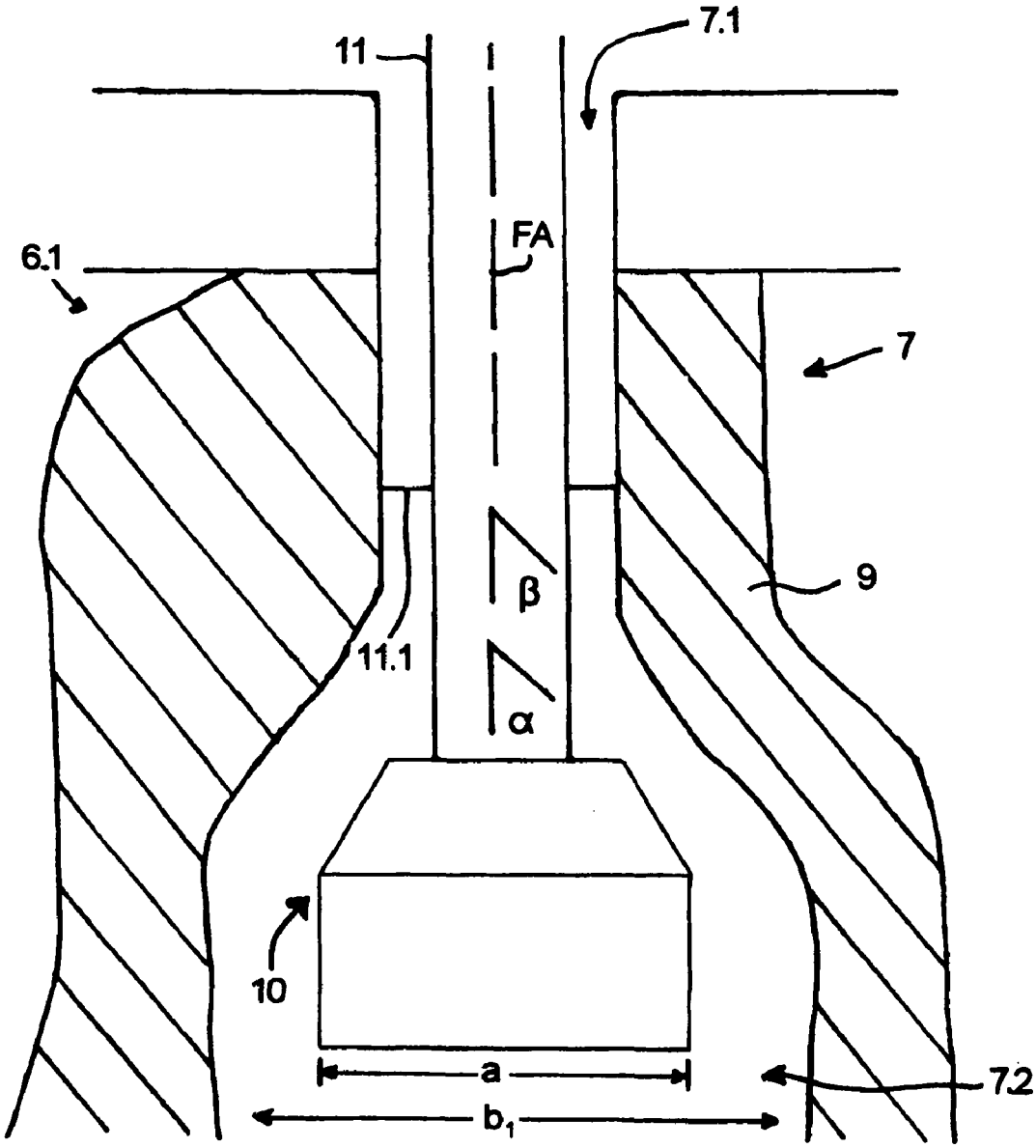
FIG. 1C is a detailed view of a portion of the filling element from FIG. 1B.

In the detailed view at FIG. 1C, there is shown one embodiment of a valve body 10 and an actuator rod 11 in a downward actuation stroke within the measurement section 7.2 of liquid duct 7. The upper portion of valve body 10 bevels or angles upwardly at a first angle $\alpha$ which, relative to vertical filling element axis FA measures between about 35-40 degrees and even 38 degrees. That contrasts with angle $\beta$ for the uppermost bevel in the valve seat, at the base of the connection 7.1 through which actuator rod 11 actuates up and down. In this representative embodiment, angle $\beta$ measures between about 42 to 47 degrees and even 44 degrees. Thus, there is a broader angle $\beta$ for the uppermost section of liquid valve 9, than runs slightly larger than the angle $\alpha$ for the uppermost section of valve body 10 that repeatedly yet periodically contacts with same in order to open and close said liquid valve 9 with the actuation of actuator rod 11, therein.

Also in FIG. 1C, there is shown, in cross-section, the relative widths of the base of the valve body 10 (as marked by arrow set a) versus the with of the liquid duct measurement section 7.2 (per arrow set $b_1$) at the downward stroke of the actuator rod 11 within liquid valve 9. The relative widths at that point show that an embodiment has a valve body base that is about 60-70%, and even 63% of the width of the measurement section that said valve body repeatedly actuates into.

Figure 2A:
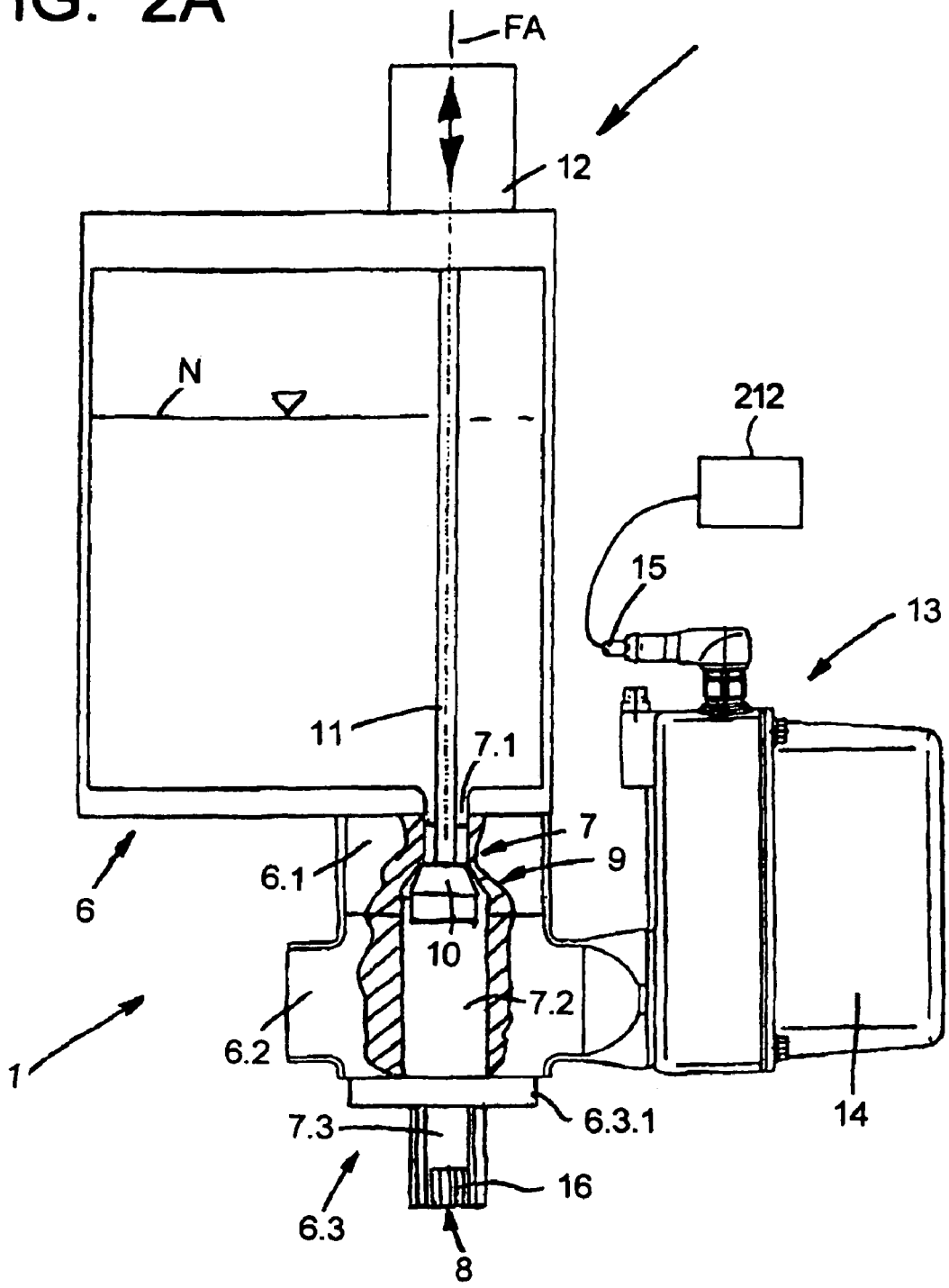
FIG. 2A shows an embodiment similar to FIG. 2 that further includes a control unit.
Figure 2B:
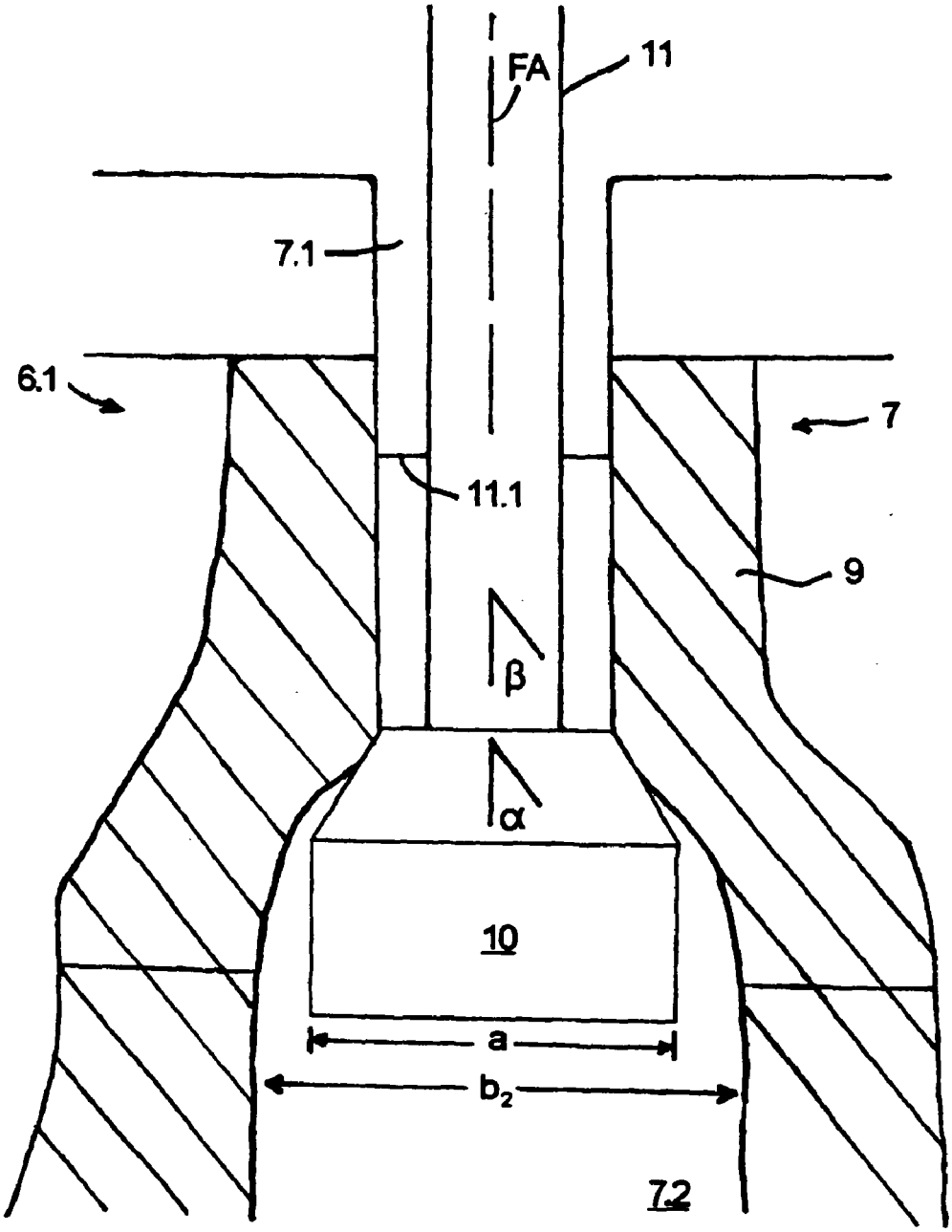
FIG. 2B is detailed view of a portion of the filling element from FIG. 2A.

The same relative angles of upper valve body 10 and uppermost liquid valve 9, relative to vertical filling element axis FA are depicted once more in the cross-sectional view of FIG. 2B, said view being an enlargement of those regions within the earlier sectional view of FIG. 2A, i.e., with the actuator rod 11 raised for indicating a closed liquid valve 9 for stopping the flow of liquid material there through and into a bottle (not shown) duly positioned beneath this filling element. FIG. 2B also indicates the relative width of the base to valve body 10 (again indicated by arrow set a) when compared to the relative width towards the top of liquid duct 9, for approximating that width when the actuator rod 11 is raised to its highest level such that the uppermost bevels of valve body 10 adjoin the valve seat area of same. The relative width of the valve body base at the elevated stroke or high point, indicated by arrow set $b_2$ in FIG. 2B, is about 80-85%, and even 83% of the width of the uppermost liquid valve 9, taking into consideration optimal manufacturing, operation, cleaning and other maintenance characteristics.

In other embodiments, the angles described could vary by plus and minus fifty percent of the angles stated in steps of one degree.

In other embodiments, the dimensions described could vary by plus and minus fifty percent of the dimensions stated in steps of one percent.

Outside housing part 6.2, in housing area 14, one can locate additional electrical components like the electronic actuation and measurement equipment of flow meter 13. Among other things, these elements actuate a magnetic coil, evaluate a measurement voltage and form a measurement signal that gets supplied via a connecting line 15 to a central control unit or computer 212 of the filling machine (see FIGS. 1B and 2A).

In these embodiments, actuator rod 11 is shorter than its earlier counterparts. It can also be made thinner and from lighter materials. More importantly, since the actuator rod does not have to pass through a magnetic inductive flow type flow meter, actuator rod 11 can be made from electrically conductive and/or magnetic materials like certain ferromagnetic alloys. When made from steels or other metal alloys, these actuator rods can better withstand the pressures of rapid, multiple movements (often at thousands of valve movements per minute). And, unlike filling elements of the past, these actuator rods will not interrupt or otherwise interfere with the signals sent back and forth between flow meter 13 and computer control unit 212.

The diameter of the liquid duct 7 and outside diameter of actuator rod 11 should be kept fairly constant in section 7.2. In that manner, the flow cross section for liquid in the measurement duct section 7.2 will not vary much with the stroke of actuator rod 11 resulting in a higher degree of measurement accuracy being achieved.

The bottles 2 are filled with the filling element 1 and with the filling machine that has these filling elements 1 in the manner described in publications for open-jet filling systems with volume control, i.e. after the inlet and positioning of the bottles 2 on the bottle carrier 5 underneath the respective filling element 1, its liquid valve 9 is opened to initiate the filling process. The filling process is terminated by closing the liquid valve 9, and namely controlled by the signal supplied by the flow meter 13.

To ensure that the flow meter 13 in the form of a magnetic inductive flow meter provides unequivocal measurements, in particular at the start of the respective filling process or the respective filling phase, a gas trap 16 is provided in section 6.3.2 or 7.3 of the liquid channel formed therein, in the vicinity of or at the discharge opening 8 and, in any case, downstream of housing section 6.2 or flow meter 13 in the direction of product flow. In another embodiment, gas trap 16 has a plurality of openings or channels and resembles a sieve-like insert. It serves as a parallel flow outlet. In yet another embodiment, a gas trap is meant to keep the periodic flow of liquid lamellar into the bottles situated there beneath.

The cross-section of these openings is chosen such that after liquid valve 9 is closed, that section of liquid channel upstream of gas trap 16 (formed by housing section 6.2) remains filled with liquid product and does not empty, at least not during the time intervals or phases of normal filling operation in which liquid valve 9 is closed. This generally ensures that section 7.2 of the liquid channel in housing section 6.2, and thus in the instrument of the flow meter 13 is completely, or nearly completely, filled with liquid product at the start of each filling phase. This enables the flow meter 13 to provide substantially unequivocal and/or substantially accurate measurement signals at or from the beginning of each filling phase.

To prevent liquid product from being prematurely forced out of liquid channel 7 the liquid valves 9 in this embodiment are designed to close by raising valve body 10 and open when lowering same.

One feature of the filling element 1 or 1*a*, and of the corresponding filling machine, is that an integrated flow meter 13 with its measuring unit and additional components can be made more efficient and compact. And with this construction, the number of transitions and/or connections that must be sealed in the liquid duct between bowl 4 and dispensing opening 8 can be reduced.

The embodiments have been described above with reference to exemplary embodiments. It goes without saying that modifications and variations can be made without going beyond the basic teaching of the present application.

One feature or aspect of an embodiment is believed at the time of filing this patent application to possibly reside broadly in a filling element for filling bottles or similar containers with a liquid to control the filling process as a function of a signal from a flow meter located in the flow path of the liquid being bottled. That flow meter is located downstream of the flow valve and in the direction of product flow. If an actuator rod is used for the liquid valve of such a system, that actuator rod can remain outside the flow meter and not have to pass through same at any time.

A further feature or aspect is believed at the time of filing to possibly reside broadly in an actuator rod that need not pass into or through the flow meter. And, such an arrangement may not adversely affect measurement accuracy. In other words, differences in contour and/or volume between individual actuator rods should generally have no adverse effect on measurements with this more forgiving system.

Another feature or aspect is believed at the time of the filing of this application possibly resides broadly in a flow meter that is not external to, but rather integrated with each filling element. Accordingly, a particularly compact filling machine design can be achieved with volumetric filling. And the number of transition areas between adjoining areas (like the reservoir, vessel or bowl and the discharge opening) can be reduced.

One other feature or aspect of an embodiment is believed at the time of the filing of this patent application to possibly reside broadly in a filling element for filling bottles or similar containers with a liquid, with a liquid duct realized in a housing of the filling element, which liquid duct forms a gas trap with a source for the liquid to be bottled and a dispensing opening for dispensing the liquid into a container to be filled, and between the connection and the dispensing opening has a liquid valve with a valve body that interacts with a valve seat, which valve body can be moved a specified distance by a shorter actuator rod for opening and closing a liquid valve and thereby controlling the filling process with signals from a flow meter located downstream, but nevertheless, still in the flow path of the liquid being bottled.

Another feature or aspect of an embodiment is believed at the time of the filing this patent application to reside in a filling element housing with flow meter connected at its lower end.

Yet another feature or aspect of an embodiment is believed at the time of the filing this patent application to possibly reside broadly in a filling element with an integral flow meter that measures liquid flow in a liquid duct between the connector and a liquid valve.

Still another feature or aspect of an embodiment is believed to at the time of the filing this patent application to possibly reside broadly in a filling element having a liquid valve and/or valve body actuated by an actuator rod system that need not extend into or otherwise through the flow meter proper.

A further feature or aspect of an embodiment is believed at the time of filing of this patent application to possibly reside broadly in a filling element characterized by the fact that said element can be fastened to the underside of a bowl of the liquid to be bottled, and that an electrically conductive and/or magnetic actuator rod extends through the interior of that bowl for interaction with a valve body at a rod end farthest from the bowl.

Some examples of inductive flow meters, such as magnetic inductive flow meters, which may possibly be adapted for use in at least one possible embodiment, may possibly be found in the following U.S. Pat. No. 5,808,208 entitled "Inductive flow meter;" U.S. Pat. No. 5,641,914 entitled "Inductive flow meter;" U.S. Pat. No. 5,121,640 entitled "Electromagnetic flow meter;" U.S. Pat. No. 4,972,722 entitled "Magnetic inductive flow meter;" and U.S. Pat. No. 4,522,073 entitled "Magnetic-inductive flow meter for high temperatures."

Some examples of bottling and container handling systems and components thereof which may possibly be utilized or adapted for use in at least one possible embodiment, may possibly be found in the following U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" U.S. Pat. No. 6,668,877, entitled "Filling System for Still Beverages;" and U.S. Pat. No. 7,299,607, entitled "Beverage Bottling Plant for Filling Bottles with a Liquid Beverage Having a Filling Element for Filling Bottles with a Liquid Beverage and a Filling Machine Having Such a Filling Element."

One example of a gas trap which may possibly be adapted for use in at least one possible embodiment, may possibly be found in the following U.S. Pat. No. 7,308,917 entitled "Beverage Bottling Plant for Filling Bottles with a Liquid Beverage Material Having a Bottle Filling Machine with a Filling Valve for Filling Bottles with a Liquid Beverage".

The components disclosed in the various publications, disclosed or incorporated by reference herein, may be used in possible embodiments of the present invention, as well as equivalents thereof.

The purpose of incorporating U.S. patents, foreign patents, publications, etc., is solely to provide additional information relating to technical features of one or more embodiments, which information may not be completely disclosed in the wording in the pages of this application. Words relating to opinions and judgments of the author and not directly relating to the technical details of the description of the embodiments therein are not to be incorporated by reference. The words: all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word(s) in this sentence, when not used to describe technical features of one or more embodiments, are not generally considered to be incorporated by reference herein.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign and international patent publication applications, namely, Federal Republic of Germany Patent Application No. 10 2006 014 103.2, filed on Mar. 24, 2006, having inventor Thomas STIENEN, and DE-OS 10 2006 014 103.2 and DE-PS 10 2006 014 103.2, and International Application No. PCT/EP2007/002574, filed on Mar. 23, 2007, having WIPO Publication No. WO2007/110197 and inventor Thomas STIENEN, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the foreign equivalent applications (identified above) is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words: all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word(s) in this sentence, when not used to describe technical features of one or more embodiments, are not generally considered to be incorporated by reference herein.

Statements made in the original foreign patent applications (above) from which this application claims priority which do not have to do with the correction of the translation of this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1, 1*a* Filling element
2 Bottle
2.1 Bottle mouth
2.2 Flange on the bottle neck
3 Jet of liquid being bottled
4 Vessel or Bowl
4.1 Gas headspace
4.2 Liquid space
5, 5*a* Bottle carrier
6 Filling element housing
6.1, 6.2, 6.3 Housing parts
6.3.1 Flange-like section
6.3.2 Tubular section
7 Liquid channel or duct
7.1 Connection or connector
7.2 Section or measuring tube/duct
7.3 Section of the liquid channel with gas trap 16
8 Dispensing or discharge opening
9, 9*a* Liquid valve
10, 10*a* Valve body
11 Actuator tappet or rod
11.1 Centering element on actuator rod 11
12 Actuator element
13 Flow meter
14 Housing
15 Control line or lead
16 Gas trap
FA Vertical filling element axis
N Liquid level in vessel/bowl 4

What is claimed is:

1. A filling element configured to fill containers with a liquid product, said filling element comprising:

a liquid channel, a liquid valve, a flowmeter, and a discharge opening;

said flowmeter being disposed at a measuring section of said liquid channel between said liquid valve and said discharge opening;

said liquid valve comprises a valve seat and a movable valve body;

said movable valve body is configured to engage with said valve seat to close said liquid valve, and is configured to be moved away from said valve seat to open said liquid valve;

said liquid channel comprises a connecting section disposed between said measuring section and a liquid source; and said movable valve body is disposed solely within said connecting section.

2. The filling element according to claim 1, wherein said discharge opening is configured to discharge liquid product from said liquid channel into a container.

3. The filling element according to claim 2, further comprising a gas trap disposed downstream of said measuring section, wherein said gas trap is configured to retain liquid in said measuring section after said liquid valve is closed and minimize entry of gas into the liquid in said measuring section.

4. The filling element according to claim 3, wherein said gas trap is disposed adjacent or at said discharge opening.

5. The filling element according to claim 4, wherein said liquid valve comprises an actuator rod connected to said valve body to move said valve body.

6. The filling element according to claim 5, wherein said liquid duct extends in an essentially straight line from a liquid source to said dispensing opening, coaxially with said actuator rod.

7. The filling element according to claim 6, wherein said gas trap has a plurality of channels for promoting lamellar fluid flow there through.

8. The filling element according to claim 7, wherein said flow sensor is a magnetic flow meter.

9. The filling element according to claim 8, wherein said actuator rod is made of an electrically conducting and/or magnetic material.

10. The filling element according to claim 9, wherein said valve body is movable in the direction of said discharge opening to open said liquid valve and in the opposite direction to close said liquid valve.

11. The filling element according to claim 10, further comprising a pneumatic actuating element configured to move said actuator rod.

12. The filling element according to claim 1, further comprising a gas trap disposed downstream of said measuring section, wherein said gas trap is configured to retain liquid in said measuring section after said liquid valve is closed and minimize entry of gas into the liquid in said measuring section.

13. The filling element according to claim 12, wherein:

said liquid valve comprises an actuator rod connected to said valve body to move said valve body; and said liquid duct extends in an essentially straight line from a liquid source to said dispensing opening, coaxially with said actuator rod.

14. The filling element according to claim 13, wherein said gas trap is disposed adjacent said discharge opening.

15. The filling element according to claim 13, wherein said gas trap is disposed at said discharge opening.

16. The filling element according to claim 1, in combination with a rotary-type filling machine, wherein said filling machine comprises a plurality of said filling elements disposed on a rotatable rotor.

17. The combination according to claim 16, wherein:

said filling machine comprises a liquid vessel or plurality of liquid vessels configured to contain a supply of liquid product; and each of said filling elements is attached to the underside of said liquid vessel or a corresponding one of said liquid vessels.

18. The combination according to claim 17, wherein:

said liquid valve comprises an actuator rod connected to said valve body to move said valve body;

each of said filling elements comprises an actuating element connected to said actuator rod to move said actuator rod and said valve body; and said actuating element and said valve body of each of said filling elements are disposed on opposite sides of said liquid vessel or a corresponding one of said liquid vessels, such that said actuator rod of each of said filling elements is disposed within the interior of said liquid vessel or a corresponding one of said liquid vessels.

* * * * *